US010327597B1

(12) United States Patent
Gillem

(10) Patent No.: US 10,327,597 B1
(45) Date of Patent: Jun. 25, 2019

(54) STAND-ALONE SHOWER SYSTEM

(71) Applicant: Vernon A. Gillem, Hazlehurst, GA (US)

(72) Inventor: Vernon A. Gillem, Hazlehurst, GA (US)

( * ) Notice: Subject to any disclaimer, the term of this patent is extended or adjusted under 35 U.S.C. 154(b) by 0 days.

(21) Appl. No.: 15/987,374

(22) Filed: May 23, 2018

Related U.S. Application Data

(60) Provisional application No. 62/511,499, filed on May 26, 2017.

(51) Int. Cl.
*A47K 3/28* (2006.01)
*E03C 1/04* (2006.01)

(52) U.S. Cl.
CPC ..... *A47K 3/284* (2013.01); *A47K 3/282* (2013.01); *E03C 1/0408* (2013.01)

(58) Field of Classification Search
CPC .... A47H 2001/0205; A47H 5/02; A47H 5/03; A47K 3/281; A47K 3/284–285; A47K 3/30; A47K 3/38; A61H 33/066; A61H 33/067; E04H 1/1244; E04H 1/1216; E04H 1/1266; E04H 2001/1288
USPC ..... 160/340, 341; 312/209, 237, 245, 312/283–290; 4/524, 525, 548, 549, 558, 4/597, 608, 610, 612–614
See application file for complete search history.

(56) References Cited

U.S. PATENT DOCUMENTS 2,983,216 A * 5/1961 Stade ..... F01N 13/085 454/5
3,007,178 A * 11/1961 Altman ..... A47K 3/28 392/397
3,750,818 A * 8/1973 Borstcher ..... A47K 3/38 211/123
6,076,904 A * 6/2000 Shepherd ..... A47B 95/008 312/209
7,849,531 B2 * 12/2010 Rooke ..... A47K 3/282 4/524
8,707,475 B2 * 4/2014 Johnson ..... A47K 3/30 4/557
8,719,975 B2 * 5/2014 Phillips ..... A47K 3/28 4/559
9,440,041 B1 * 9/2016 Lacayo ..... A61M 16/14
9,526,379 B2 * 12/2016 Hoernig ..... A47K 3/283
2010/0101013 A1 * 4/2010 von Obstfelder ..... B64D 11/02 4/612
2015/0182076 A1 * 7/2015 Berke ..... A47K 3/281 312/209

* cited by examiner

*Primary Examiner* — David P Angwin
*Assistant Examiner* — Nicholas A Ros
(74) *Attorney, Agent, or Firm* — Jonathan Rigdon Smith, J.D., P.C.; Jonathan R. Smith

(57) ABSTRACT

A stand-alone shower system includes a cylindrical shower compartment with a transparent, translucent, or opaque wall and door, one or more specially configured shower nozzles, an optional storage compartment, and an optional surrounding cylindrical privacy curtain.

10 Claims, 3 Drawing Sheets

STAND-ALONE SHOWER SYSTEM

CROSS-REFERENCES TO RELATED APPLICATIONS

This U.S. nonprovisional application for patent claims priority of U.S. provisional patent application No. 62/511,499, filed May 26, 2017.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

REFERENCE TO A BIOLOGICAL SEQUENCE LISTING

Not applicable.

BACKGROUND OF INVENTION

Field of the Invention

This invention is in the field of bathing apparatuses, more specifically showers, and still more specifically stand-alone showers or showers that are not built into a wall or corners of a room.

Description of the Related Art

Typically, a shower enclosure is placed in the corner of a room, or in a recess in a wall, or in some especially partitioned-off portion of the room, which requires some integration of the shower enclosure into the room itself. While these designs are widely used, many consumers demand a more architecturally or aesthetically appealing enclosure or showering atmosphere. Although many contemporary shower designs incorporate aesthetically pleasing materials, functional hardware, and architecture into the showering environment, these shower designs are typically custom enclosures designed by architects or interior designers on a case-by-case basis.

A simple form of shower that can be installed near a wall but not incorporating the wall itself is a spray head mounted within a ring, which in turn is mounted on or near the wall. Water is plumbed to the spray head from a water source near or on the wall, and a curtain is suspended from the ring. A "stand-alone" version of such a shower includes a base with a vertical support rod holding the ring at a desired height. The shower head, base, or support rod may be fed water from a hose or dedicated pipe. Wastewater may drain to a sewer system, septic tank, or into the ground. Such showers may be seen at camp sites and pool areas.

While such showers are inexpensive and may even be portable, one can assume that consumers do not buy them for aesthetic reasons. There is a need and a potential market for an aesthetically pleasing indoor stand-alone shower, that is, a shower that is not mounted on or within a wall or in a corner.

BRIEF DESCRIPTION OF THE INVENTION

Objects of the Invention

Objects of this invention include: providing an aesthetically pleasing and interesting stand-alone shower; providing various showering implements; and optionally providing built-in storage and shower entry means.

Summary of the Invention

A shower system is provided that includes a cylindrical shower compartment with a transparent, translucent, or opaque wall and door, one or more specially configured shower nozzles, an optional storage compartment, and an optional surrounding cylindrical privacy curtain.

DETAILED DESCRIPTION OF THE INVENTION

Figure 1:
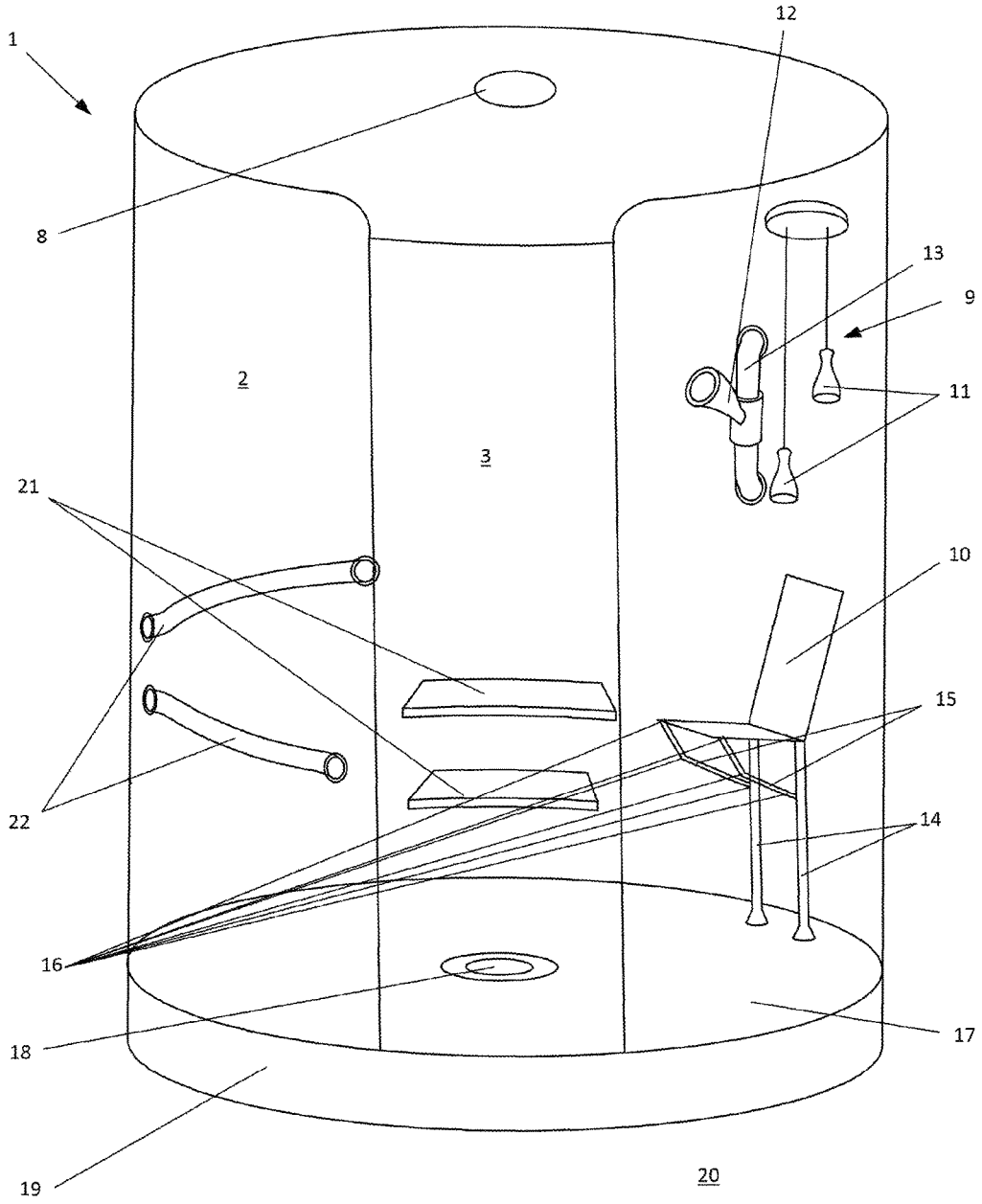
FIG. 1 is a perspective view of a shower system according to an embodiment of the present invention.

Although the drawings represent some preferred embodiments of the present invention, the drawings are not necessarily to scale and certain features may be exaggerated to better illustrate and explain the present invention. Further, the embodiments set forth herein are not intended to be exhaustive or otherwise limit or restrict the invention to the precise forms and configurations shown in the drawings and disclosed in the following detailed description. Referring now to the drawings, in which like reference characters refer to like elements among the drawings, FIG. 1 is a front perspective view of a shower system according to an embodiment of the present invention. The preferred embodiment of shower system 1 generally includes at least a cylindrical enclosure 2, a curved door 3, and a main shower head 8. In the preferred embodiment, the enclosure 2 and the door 3 are transparent, and it includes a curtain (not shown in this view). Because the enclosure 2 is preferably transparent, the following features are visible without cross-section or cutaway of the view. Also included in the preferred embodiment is a plurality of auxiliary shower heads 9 and a movable seat 10. The plurality of shower heads 9 may include one or more rain heads 11 and/or an arc spray 12 mounted on a rack bar 13. The arc spray 12 may be disengaged from the rack bar 13 for use as a hand-held shower wand. The seat 10 has adjustable support legs 14 and seat support brackets 15. The support brackets may be hinged at points 16 to permit the seat 10 to be folded down against the legs 14.

The shower system 1 also has a drain 18, a custom floor 17, and an optional pedestal 19 holding it above the level of the room floor 20. Further optional features are handrails 22, preferably transparent plastic, and rear shelves 21. As will be discussed in detail below, this described modularity of shower system 1 allows some or all of the components to be arranged in one of several different configurations to accommodate the environment in which the shower system 1 is installed or the particular taste of the user.

Figure 2:
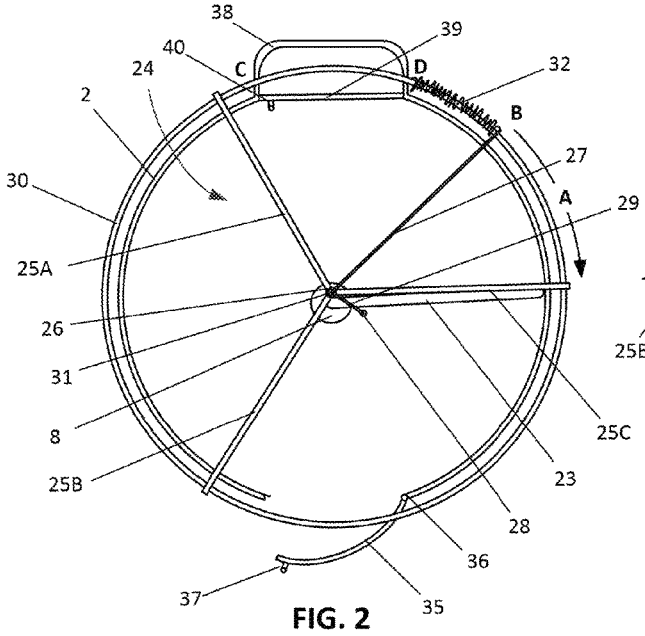
FIG. 2 is a top view of the preferred embodiment of the present invention.

FIG. 2 is a top view of the preferred embodiment of the present invention. The cylindrical enclosure 2 appears in this view as concentric circles and consists of clear acrylic or the like. A main shower pipe 23 crosses from a water feed pipe coming up from the floor (not shown) to a main shower head 8. A curtain ring support frame 24 consisting of three brackets 25A, 25B, and 25C and a central bearing 26 is attached to the upper edge of the enclosure 2. A curtain ring 30 is attached to the upper surfaces of the outer ends of the brackets 25. A curtain ring pull arm 27 has a handle 28 and a crank 29. The pull arm 27 is rotatable clockwise and counterclockwise through arc A from point B to point C. The pull arm 27 is connected to the crank 29 by a vertical shaft 31 which passes through the bearing 26. A shower curtain 32, shown from above in multiple folds, is suspended from the curtain ring. The top of the trailing end of the shower curtain 32 is fixed to the curtain ring at point D. At the front of the enclosure 2 (bottom of this view) is a door 35 connected to the enclosure 2 by a door hinge 36. The door 35 has a door pull 37. At the rear of the enclosure 2 (top of this view) is a cabinet 38, having a cabinet door 39 opening inward. The cabinet door 39 has a cabinet door pull 40.

Figure 3:
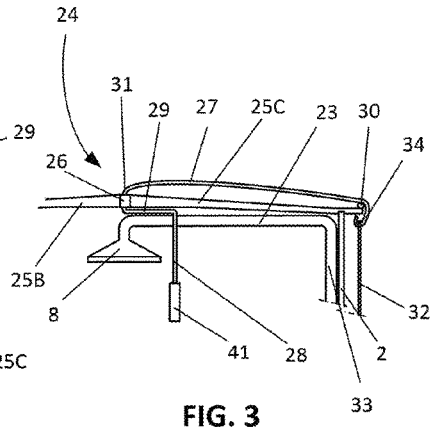
FIG. 3 side view of the superstructure of the present invention.

FIG. 3 side view of the superstructure of the present invention. Again, the main shower pipe 23 is shown to cross from a water supply pipe 33 coming up from the floor to the main shower head 8. The curtain ring support frame 24 consisting of the visible brackets 25B and 25C and the central bearing 26 is attached to the upper edge of the enclosure 2. The curtain ring 30 is attached to the upper surfaces of the outer ends of the brackets 25. The curtain ring pull arm 27 has a a crank 29, a handle 28, and a handle grip 41. The pull arm 27 is connected to the crank 29 by the vertical shaft 31, which passes through the bearing 26. The pull arm 27 passes over the curtain ring 30 and terminates in a pull hook 34. The top leading edge of the shower curtain 32 is connected to the pull hook 34. A plurality of free curtain hooks (not shown) slide over the curtain ring 30 as they would in a conventional shower curtain. The entire structure shown in FIG. 3 may be left open or covered by a decorative roof (not shown).

Figure 4:
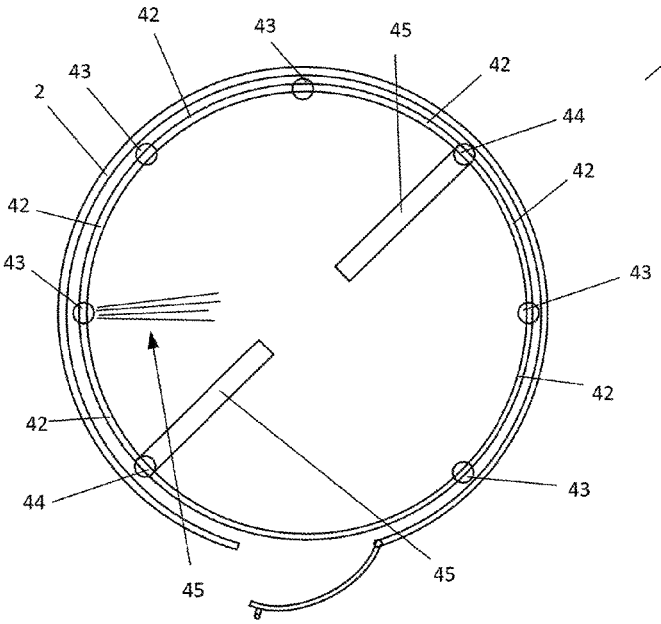
FIG. 4 is a cutaway top view of another embodiment of the invention.

FIG. 4 is a cutaway top view of another embodiment of the invention. This embodiment has the same features as the embodiments shown in FIGS. 1, 2 and 3 except for delivery of water to the shower. Instead of the vertical supply pipe 33 and shower head 8, water is delivered to various vertical shower sprays 43 and 44 by flex lines 42 installed peripherally around the inside lower edge of the enclosure 2. The shower sprays 43 thrust water substantially horizontally toward the center as shown at 45, see also FIG. 6. The shower angle sprays 44 thrust water obliquely toward the shower center as shown also in FIG. 5. The number and angular placement of these two types of sprays may be varied according to customer wishes.

Figures 5, 6:
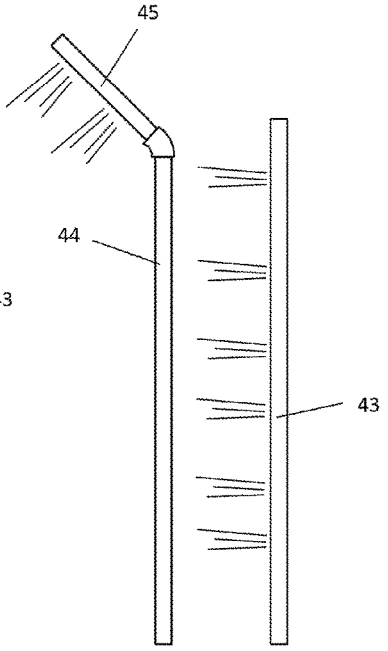
FIG. 5 is a side view of an overhead vertical shower spray in embodiments of the present invention.
FIG. 6 is a side view of a side spray in embodiments of the present invention.

FIG. 5 is a side view of an overhead vertical shower spray 44, which is shown from above in FIG. 4.

FIG. 6 is a side view of a side spray 43, which is shown from above in FIG. 4.

Figure 7:
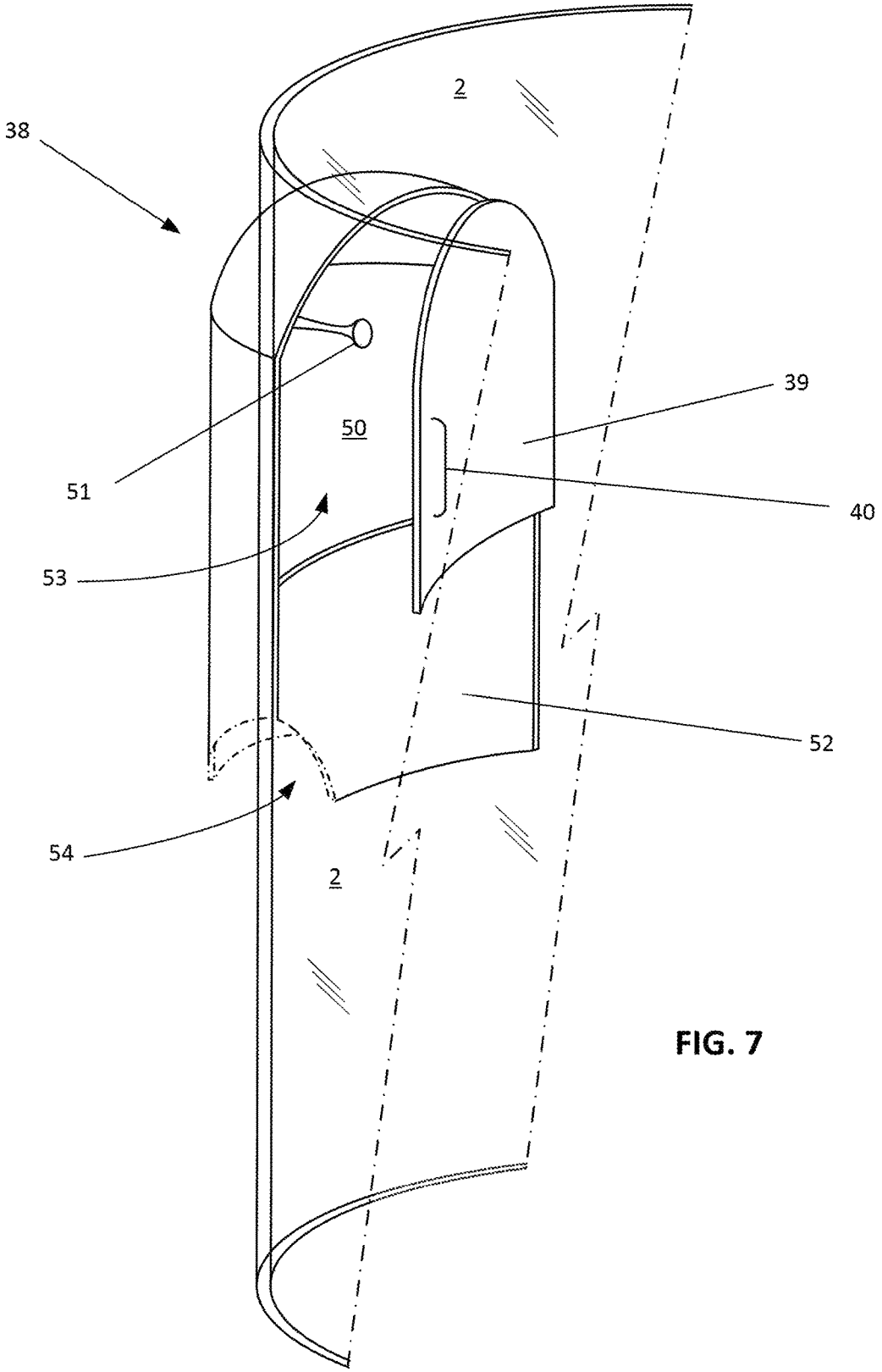
FIG. 7 is an oblique view of optional cabinet structure for embodiments of the present invention.

FIG. 7 is an oblique view of optional cabinet structure for embodiments of the present invention. The optionally transparent enclosure 2 is shown here in cutaway. At the rear of the enclosure 2 (left in this view) is a cabinet 38 to which access is obtained through a hole 53 in the wall of the enclosure 2. In embodiments, the cabinet 38 may be mounted at other locations on the periphery of the enclosure 2. The cabinet 38 is preferably made of opaque material, such as wood, and has a cabinet door 39 opening towards the center of the enclosure 2. The cabinet door 39 has a cabinet door pull 40. The space 50 behind the door 39 is open for hanging, e.g., a bathrobe, on a rod 51. The space 50 extends downward behind an opaque panel 52 and is optionally open 54 (see cutaway) at the bottom.

An optional feature not shown in the drawings is an entry platform outside the shower door 3 which may include a step up into the shower and a safety handrail.

The present invention has been particularly shown and described with reference to the foregoing embodiments, which are merely illustrative of the best modes for carrying out the invention. It should be understood by those skilled in the art that various alternatives to the embodiments of the invention described herein may be employed in practicing the invention without departing from the spirit and scope of the invention. This description of the invention should be understood to include all novel and non-obvious combinations of elements described herein, and claims may be presented in a later application to any novel and non-obvious combination of these elements. Moreover, the foregoing embodiments are illustrative, and no single feature or element is essential to all possible combinations.

I claim:

1. A shower apparatus, comprising:

a transparent stand-alone arcuate wall;

an entry door through the wall;

a cabinet mounted on the wall exteriorly to the wall and having a cabinet door opening towards the interior of the stall, the cabinet having an open bottom;

a main shower head proximate to the center of the upper end;

at least one auxiliary shower head taken from the list containing:

(a) at least one rain head;

(b) an arc spray;

(c) an arc spray removably attached to said wall;

(d) at least one vertical shower spray;

(e) any combination of the above; and a means for adjustably covering at least the transparent portions of said wall and said entry door.

2. The apparatus of claim 1, wherein:

said wall has an upper edge; and said means comprises a curtain ring suspended outwardly from the upper edge;

a curtain suspended from the curtain ring;

a central bearing attached to the upper edge;

a curtain ring pull arm having a proximal end and a distal end;

the proximal end having a vertical shaft through the central bearing;

the vertical shaft having a hand crank;

the distal end having a curtain pull hook;

the pull hook engaging the curtain.

3. The apparatus of claim 2, wherein:

said door is transparent; and said cabinet has an open bottom.

4. The apparatus of claim 3, comprising:
a repositionable seat.
5. The apparatus of claim 4, comprising:
at least one shelf.
6. A shower apparatus, comprising:
a transparent stand-alone wall;
an entry door through the wall;
a cabinet mounted on the wall exteriorly to the wall and having a cabinet door opening towards the interior of the stall, the cabinet having an open bottom;
a main shower head proximate to the center of the upper end;
at least one auxiliary shower head taken from the list containing:
(a) at least one rain head;
(b) an arc spray;
(c) an arc spray removably attached to said wall;
(d) at least one vertical shower spray;
(e) any combination of the above; and
a means for adjustably covering at least the transparent portions of said wall and said entry door.
7. The apparatus of claim 6, wherein:
said wall has an upper edge; and
said means comprises a curtain ring suspended outwardly from the upper edge;
a curtain suspended from the curtain ring;
a central bearing attached to the upper edge;
a curtain ring pull arm having a proximal end and a distal end;
the proximal end having a vertical shaft through the central bearing;
the vertical shaft having a hand crank;
the distal end having a curtain pull hook;
the pull hook engaging the curtain.
8. The apparatus of claim 7, wherein:
said door is transparent; and
said cabinet has an open bottom.
9. The apparatus of claim 8, comprising:
a repositionable seat.
10. The apparatus of claim 9, comprising:
at least one shelf.

* * * * *